US007367274B2

(12) United States Patent
Sadasue

(10) Patent No.: US 7,367,274 B2
(45) Date of Patent: May 6, 2008

(54) DARNING WIDTH ADJUSTING DEVICE FOR SEWING MACHINE

(75) Inventor: Kazuya Sadasue, Hiroshima (JP)

(73) Assignee: Juki Corporation, Tokyo (JP)

( * ) Notice: Subject to any disclaimer, the term of this patent is extended or adjusted under 35 U.S.C. 154(b) by 34 days.

(21) Appl. No.: 11/394,402

(22) Filed: Mar. 31, 2006

(65) Prior Publication Data

US 2006/0230502 A1 Oct. 19, 2006

(30) Foreign Application Priority Data

Apr. 1, 2005 (JP) ..... 2005-106184

(51) Int. Cl.
*D05B 37/04* (2006.01)
*D05B 73/12* (2006.01)

(52) U.S. Cl. ..... 112/122; 112/464

(58) Field of Classification Search ..... 112/122, 112/122.1, 153, 461, 462, 464, 260
See application file for complete search history.

(56) References Cited

U.S. PATENT DOCUMENTS 4,331,089 A * 5/1982 Widmer ..... 112/470.04
5,216,970 A * 6/1993 Sakuma ..... 112/168
5,529,003 A * 6/1996 Kojima et al. ..... 112/168
5,806,448 A * 9/1998 Matsuo et al. ..... 112/162

FOREIGN PATENT DOCUMENTS

| | | |
|---|---|---|
| JP | 55-78991 | 6/1980 |
| JP | 1-299585 | 12/1989 |
| JP | 3-140186 | 6/1991 |
| JP | 405031273 A * | 2/1993 |
| JP | 2005-401 | 1/2005 |

* cited by examiner

*Primary Examiner*—Ismael Izaguirre
(74) *Attorney, Agent, or Firm*—Merchant & Gould P.C.

(57) ABSTRACT

A darning width adjusting device for a sewing machine includes a lower knife holder supported by a sewing machine frame such that a moving position of the lower knife holder is adjustable in a direction orthogonal to a cloth feeding direction, a thread-sliding piece which sets a darning width by picking up a thread at a tip thereof in the vicinity of a stitch point, a thread-sliding piece holder supported by the sewing machine frame such that a moving position of the thread-sliding piece is adjustable in the orthogonal direction to the cloth feeding direction, a thread-sliding piece adjusting means for adjusting the moving position of the thread-sliding piece, and a lower knife holder adjusting means for adjusting the moving position of the lower knife holder to a position exceeding a outside marginal position of the thread-sliding piece.

6 Claims, 6 Drawing Sheets

DARNING WIDTH ADJUSTING DEVICE FOR SEWING MACHINE

The present invention claims foreign priority to Japanese patent application no. 2005-106184, filed on Apr. 1, 2005, the content of which is incorporated herein by reference.

BACKGROUND OF THE INVENTION

1. Field of the Invention

The invention relates to a darning width adjusting device for a sewing machine such as an overlock machine.

2. Description of the Related Art

A conventional over-edge sewing machine includes an upper knife and a lower knife, both cutting a workpiece cloth at upstream side of a stitch point in a cloth feeding direction, a lower knife holder provided movably in a direction orthogonal to the cloth feeding direction and holding the lower knife, a thread-sliding piece supported on the lower knife holder and adjusting a darning width by engaging a tip portion of the thread-sliding piece with a thread in the vicinity of the stitch point, and a positioning device positioning the lower knife in the direction orthogonal to the cloth feeding direction (for example, see JP-A-2005-000401).

However, in the conventional over-edge sewing machine, since the thread-sliding piece is supported on the lower knife holder, when the lower knife holder is moved outward to assure a wide cloth cutting width, an upper looper moving from underside of a throat plate toward a sewing needle and the thread-sliding piece interfere with each other (for example, see FIG. 6). Thus, there is an inconvenience that the outward moving amount of the lower knife is limited.

As a result, when over-edge sewing is carried out on an elastic cloth for example, a width from the stitch point to a cutting portion of a workpiece is insufficient so that a thread reeling piece cannot follow the expansion and contraction of the cloth (e.g., the cloth after being cut contracts and causes thread redundancy). Consequently, there is a problem that the darning cannot be suitably aligned with the cloth end.

In order to overcome the above problem, a thread tensioner can be operated to adjust a tension of the thread, thereby dealing with a change in the darning width. However, this leads to a serious problem that an adjusting operation is troublesome so that considerable labor is required for an operator and an operating efficiency is lowered,

SUMMARY OF THE INVENTION

It is an object of the present invention to provide a darning width adjusting device for a sewing machine that is capable of positioning a thread-sliding piece separately from a lower knife in a direction orthogonal to a cloth feeding direction.

According to a first aspect of the invention, a darning width adjusting device for a sewing machine may be used in a sewing machine which cuts an edge of a workpiece fed to a stitch point by an upper knife and an lower knife arranged at an upstream side of the stitch point in a cloth feeding direction. The darning width adjusting device for a sewing machine includes a lower knife holder which holds the lower knife and supported by a sewing machine frame such that a moving position of the lower knife holder is adjustable in a direction orthogonal to the cloth feeding direction;

a thread-sliding piece which sets a darning width by picking up a thread on a tip of the thread-sliding piece in a vicinity of the stitch point;

a thread-sliding piece holder which holds the thread-sliding piece and supported by the sewing machine frame such that a moving position of the thread-sliding piece is adjustable in the orthogonal direction to the cloth feeding direction from a first position providing the narrowest darning width to an outside marginal position providing the widest darning width;

a thread-sliding piece adjusting means for moving the thread-sliding piece holder such that the moving position of the thread-sliding piece is adjusted from the first position to the outside marginal position; and a lower knife holder adjusting means for adjusting the moving position of the lower knife holder from a position corresponding to the first position of the thread-sliding piece to another position exceeding a position corresponding to the outside marginal position of the thread-sliding piece.

According to a second aspect of the invention, as set forth in the second aspect of the invention, the thread-sliding piece may be provided such that the moving position of the tip of the thread-sliding piece can be adjusted in the orthogonal direction to the cloth feeding direction.

According to a third aspect of the invention, as set forth in the first or second aspect of the invention, the darning width adjusting device for a sewing machine may include an adjusting shaft provided parallel to the orthogonal direction to the cloth feeding direction and slidably supported by the sewing machine frame, the adjusting shaft penetrating through the lower knife holder, wherein the lower knife holder has a supporting shaft extending parallel to the adjusting shaft and slidably supported by the sewing machine frame, the thread-sliding piece holder is slidably supported by the adjusting shaft, the supporting shaft is coupled with the lower knife holder adjusting means, and the adjusting shaft is coupled with the thread-sliding piece adjusting means.

According the first aspect of the invention, the lower knife is supported by the lower knife holder and the thread-sliding piece is supported by the thread-sliding piece holder, the lower knife holder and the thread-sliding piece being different bodies. In addition, the lower knife can be moved more outwards than the outside marginal position of the thread-sliding piece holder in the lateral direction by the lower knife holder adjusting means. Therefore, the thread-sliding piece which may interfere with the upper looper is limited in its moving amount so as not to move to the position interfering with the upper looper (outside marginal position), while the lower knife can be moved further outwards without being limited by the moving amount of the thread-sliding piece. Thus, the width from the stitch point to the cutting position of the upper knife and the lower knife can be assured sufficiently wide. Accordingly, even when darning is made on e.g. an elastic cloth, the darning can be suitably aligned to the cloth end after cutting. As a result, darning can be suitably made on various cloths.

It should be noted that the term "outside" of outside marginal position refers to the direction gradually moving away from the stitch point of the sewing machine in the above lateral direction which is orthogonal to the cloth feeding direction.

According to the second aspect of the invention, the same effect as the first aspect of the invention can be obtained. In addition, the lateral position of the tip of the thread-sliding piece can be adjusted independently of the lateral moving amount of the lower knife holder. So, both distances of the thread-sliding piece and the lower knife from the stitch point can be set individually. Thus, even when darning is made on the elastic cloth, it can be suitably made according to material changes with no thread redundancy or thread shortage due to the thickness or contractive property of the elastic cloth.

According to the third aspect of the invention, the same effect as the first or second aspect of the invention can be obtained. In addition, since the thread-sliding piece is involved with the thread-sliding piece adjusting means further capable of individually adjusting the lateral position of the tip of the thread-sliding piece, fine adjustment of the darning width can be easily made without adjusting positions of the thread-sliding piece holder and lower knife holder in the above lateral direction. By combining adjusting means for the thread-sliding piece holder and the lower knife holder to move in the lateral direction, the adjustable range of the darning width can be further extended, and the operation of adjusting the darning width can be simplified, thereby improving the working efficiency.

DESCRIPTION OF THE EXEMPLARY EMBODIMENT

Now referring to FIGS. 1 to 6, a detailed explanation will be given of an embodiment of a darning width adjusting device for a sewing machine according to the present invention. It should be noted in the following description that the direction along the cloth feeding direction on a plane along a throat plate 103 of the sewing machine 100 represents a Y-axis direction; the direction orthogonal to the cloth feeding direction represents an X-axis direction; and the direction perpendicular to the plane of the throat plate 103 represents a Z-axis direction.

[Entire Configuration]

Figure 1:
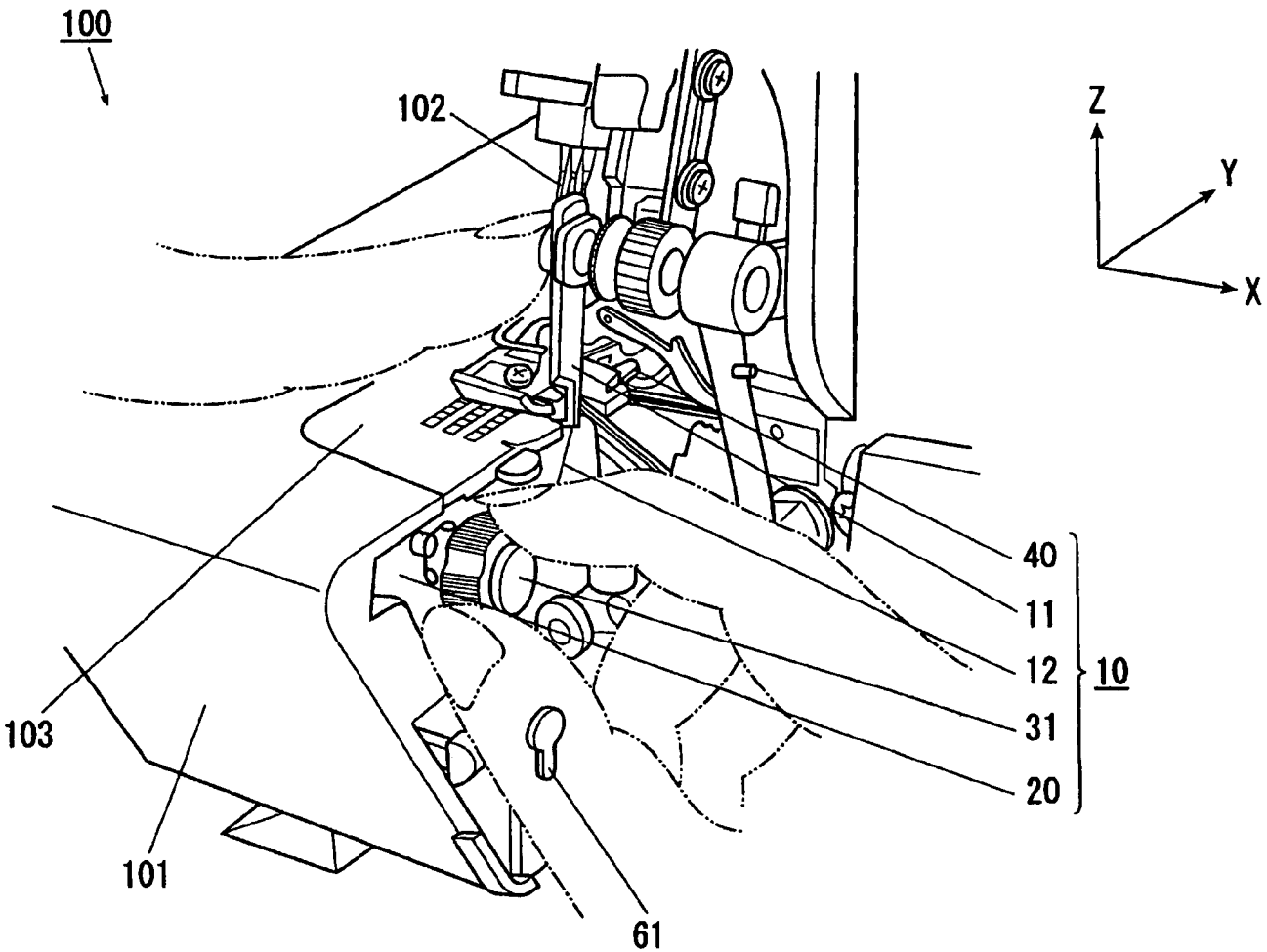
FIG. 1 is a perspective view of the peripheral configuration of an upstream side of a bed unit 101 of a sewing machine 100 in a cloth feeding direction where a darning width adjusting device 10 according to an embodiment of the invention is employed.

FIG. 1 is a perspective view of the peripheral configuration of an upstream side of a bed unit 101 of a sewing machine 100 in a cloth feeding direction where a darning width adjusting device 10 for a sewing machine (hereinafter simply referred to as a darning width adjusting device 10) according to the embodiment of the invention is employed.

As seen from FIG. 1, the main part of the darning width adjusting device 10 is arranged upstream of the stitch point of a sewing needle 102 in the cloth feeding direction.

The darning width adjusting device 10 includes an upper knife 11 and a lower knife 12 for cutting the edge of a workpiece cloth fed to the stitch point; a knife driving mechanism (not shown) for holding the upper knife 11 to vertically move the upper knife 11 toward the lower knife 12; a lower knife holder 20 for holding the lower knife 12, supported by a sewing machine frame 104 so that the moving position of the lower knife holder 20 for holding the lower knife 12 can be adjusted in a lateral direction (X-direction) orthogonal to the cloth feeding direction; a thread-sliding piece 40 for setting the darning width in such a manner that a thread is picked up by the tip of the thread-sliding piece in the vicinity of the stitch point when sewing; a thread-sliding piece holder 51 for holding the thread-sliding piece 40, supported by the sewing machine frame 104 so that the moving position of the thread-sliding piece holder 51 can be adjusted in the lateral direction (X-axis direction); a lower knife adjusting means capable of adjusting the moving position of the lower knife holder 20 more outwards than the outer marginal position of the thread-sliding piece holder 51; and a thread-sliding piece adjusting means 60 capable of adjusting the lateral position of the tip 40*a* of the thread-sliding piece 40 relative to the lower knife holder 20.

The darning width adjusting device 10 further includes an adjusting shaft 34 with an adjusting knob 31 formed at its tip which is an operating portion for inputting rotary force and is extended along the X-axis direction. As described later, the adjusting shaft 34 is passed through a passing-through hole 25 of the lower knife 20 and through-holes 51*c*, 51*c* of the thread-sliding piece holder 51, and supported by the sewing machine frame 104 by penetration through a sleeve 35.

It should be noted that the "outwards" refers to the direction gradually moving away from the stitch point of the sewing machine in the above lateral direction which is orthogonal to the cloth feeding direction.

The respective components will be described below.

[Lower Knife and Lower Knife Holder]

Figure 2:
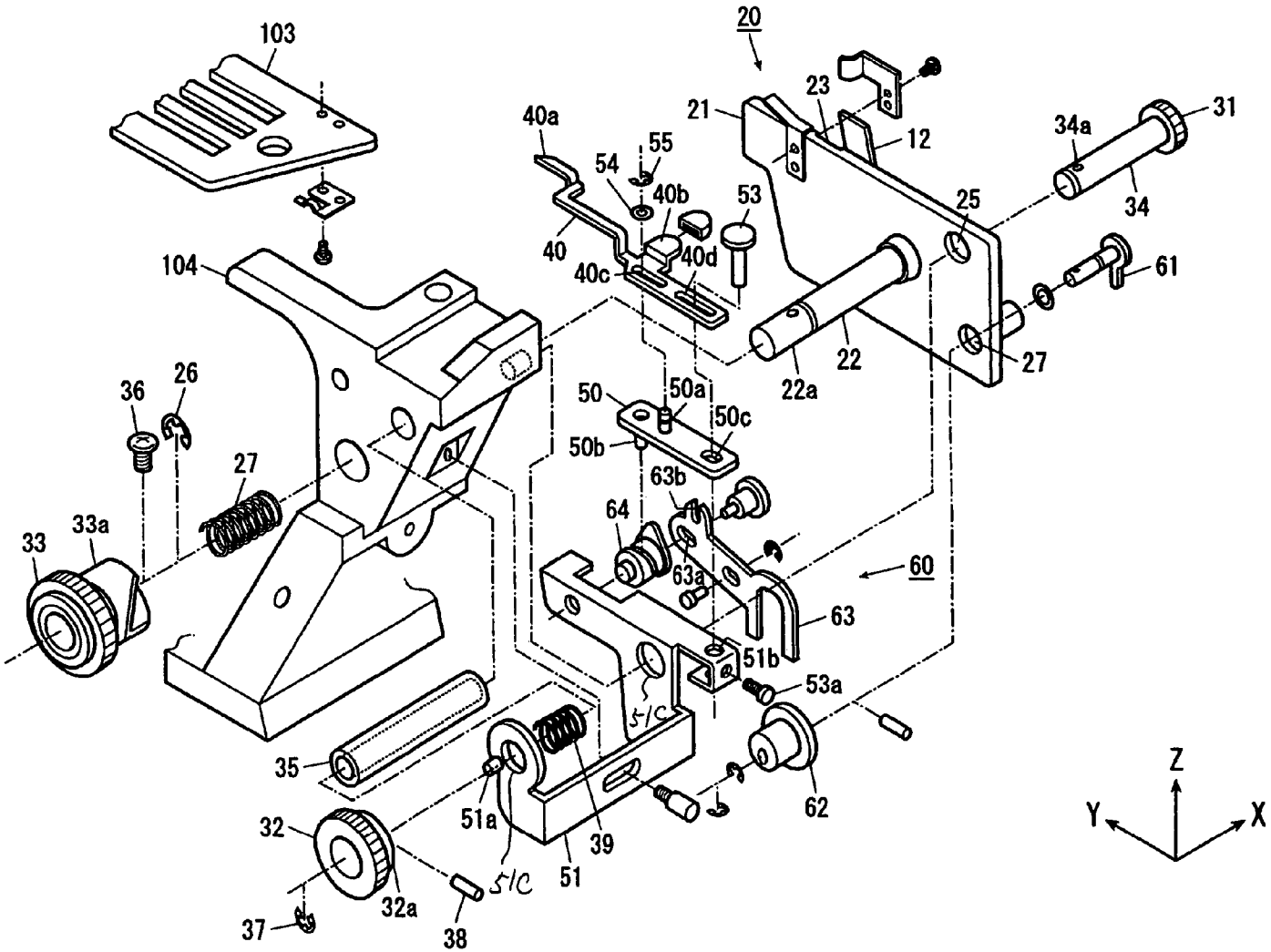
FIG. 2 is an exploded perspective view of the main part of the darning width adjusting device 10 according to the embodiment.
Figure 3:
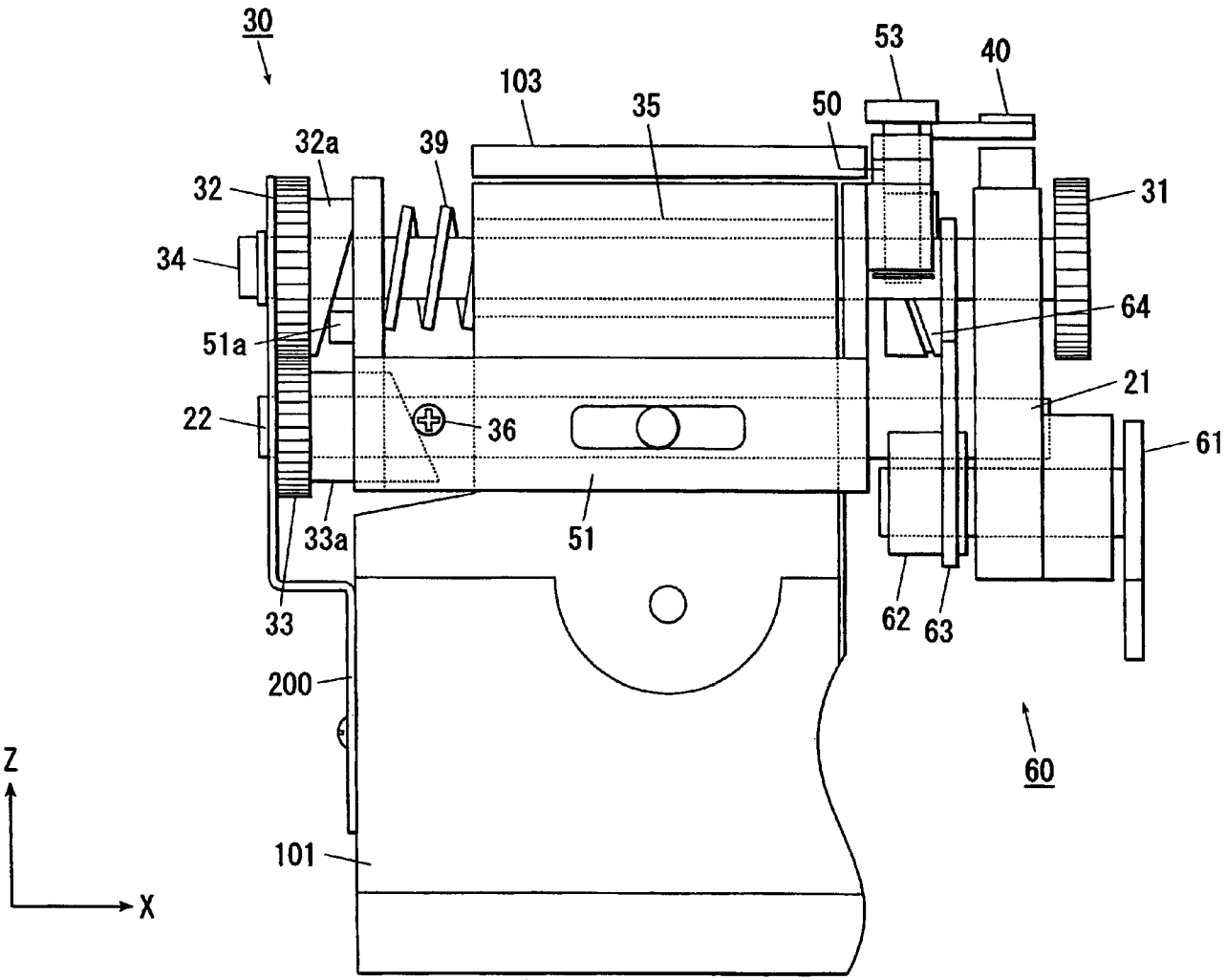
FIG. 3 is a front view of the main part of the darning width adjusting device 10 according to the embodiment.

FIG. 2 is an exploded perspective view of the main part of the darning width adjusting device 10 according to the embodiment, and FIG. 3 is a front view thereof.

First, the lower knife holder 20 will be explained.

The lower knife holder 20 has a nearly-plate-like holder body 21 and a supporting shaft 22 secured to the one planar face thereof. The supporting shaft 22 is arranged parallel to the above lateral direction (orthogonal direction to the cloth feeding direction) and slidably inserted through the sewing machine frame 104.

The holder body 21 has a guide groove 23 formed on the planar face opposite to the supporting shaft 22. The lower knife 12 is mounted on the guide groove 23 and secured by a metallic plate. Further, the holder body 21 has a passing-through hole 25 into which the adjusting shaft 34 is loosely inserted. The passing-through hole 25 is formed so as to penetrate through the planar faces.

The holder body 21 is arranged so that its planar faces are located along the Y-Z plane. The holder body 21 is arranged such that the holder body is movable along the X-axis direction with respect to the sewing machine frame 104 via the supporting shaft 22.

The supporting shaft 22 is inserted through a through-hole formed along the X-axis direction in the sewing machine frame 104 and supported slidably along the X-axis direction.

Further, an end portion 22*a* of the supporting shaft 22 opposite to the holder body 21 is loosely inserted in a lower knife adjusting stand 200 and supported so that it is pivotable and also movable in the X-axis direction.

In the vicinity of the end portion 22*a* of the supporting shaft 22, an E-ring 26 is provided. A coil spring 27 is provided in a state that the supporting shaft 22 is inserted therethrough with the E-ring 26 serving as a stopper. The coil spring 27 is adapted to generate pressing force between the E-ring 26 and the sewing machine frame 104. Thus, the holder body 21 and the supporting shaft 22 are always pressed leftward in FIG. 3. The supporting shaft 22 is provided, at its end, with a follower gear 33 of a lower knife adjusting means 30 which will be described later. The end face of the follower gear 33 is positioned in contact with the above lower knife adjusting stand 200 (see FIG. 3).

[Thread-Sliding Piece]

Next, the thread-sliding piece 40 will be explained.

The thread-sliding piece 40 is arranged between the lower knife holder 20 and the sewing machine frame 104 described above.

The thread-sliding piece 40 is formed in an elongate plate-like shape, and arranged so that a longitudinal direction thereof is in nearly parallel to the Y-axis direction. The tip 40*a* of the thread-sliding piece 40 is tapered and also bent in a hook shape so that the right edge thereof is normally movable more outwardly than the right edge of the holder body 21 (see FIGS. 2 and 6).

Further, the thread-sliding piece 40 has passing-through elongate holes 40*c* and 40*d* formed along the longitudinal direction thereof-at a middle point and a base end point in the longitudinal direction. Namely, since the thread-sliding piece 40 is supported by a swinging piece 50 (which will be described late) through these length holes 40*c* and 40*d*, it is movable along each of the elongate holes 40*c* and 40*d* so that a position of the thread-sliding piece is switchable between a using position and non-using position.

Further, the thread-sliding piece 40 has an extended switching knob 40*b* for switching the thread-sliding piece 40 between the using position and the non-using position along the X-axis direction from the middle area in the longitudinal direction of the thread-sliding piece 40.

In accordance with the above structure, the thread-sliding piece 40 is adapted in over-edge sewing so that when it is located at the using position, the thread reeled out from the lower surface of a workpiece cloth to the upper surface is picked up on the one end side (right side in FIG. 6) of the tip 40*a* of the thread-sliding piece 40 in the X-axis direction, thereby assuring the thread darning width in the over-edge sewing.

The thread-sliding piece 40 is supported by a swinging piece 50 arranged therebelow through the above elongate holes 40*c* and 40*d*.

[Thread-Sliding Piece Adjusting Means]

A thread-sliding piece adjusting means 60 has the swinging piece 50. The swinging piece 50 is formed in an elongate plate-like shape and arranged so that its longitudinal direction is in nearly parallel to the Y-axis direction. On the upper surface at a nearly middle point of the swinging piece 50, an engagement projection 50*a* is formed. The engagement projection 50*a* is slidably engaged along the elongate hole 40*c* of the thread-sliding piece 40 and secured by an E-ring 54 via a washer.

Further, on the lower surface at the one end of the swinging piece 50, another engagement projection 50*b* is formed. The engagement projection 50*b* is engaged in the groove of a thread-sliding piece swinging groove cam 64 of a thread-sliding piece adjusting mechanism 60 described later.

In the vicinity of the other end of the swinging piece 50, a through-hole 50*c* penetrating through the swinging piece 50 in the Z-axis direction is formed. Through this through-hole 50*c*, the swinging piece is swingably coupled with the upper face at the one end of the sliding piece holder 51 serving as a thread-sliding piece adjusting means described later by means of a pin member 53 serving as a supporting shaft.

[Thread-Sliding Piece Adjusting Means 60 and Thread-Sliding Piece Holder 51]

Next, the thread-sliding piece adjusting means 60 and the thread-sliding piece holder 51 will be explained.

The thread-sliding piece adjusting means 60 includes the thread-sliding piece 51 for swingably supporting the swinging piece 50, a thread-sliding piece finely adjusting lever 61 which is an input operation unit for adjusting the swinging angle of the swinging piece 50 to be positioned, a thread-sliding piece adjusting eccentric cam 62 which is rotationally moved by the thread-sliding piece finely adjusting lever 61, a link member 63 which is swung by the thread-sliding piece adjusting eccentric cam 62, a thread-sliding piece swinging groove cam 64 which is given a reciprocating rotational movement by the link member 63 and provides swinging force to the swinging piece 50, a thread-sliding piece adjusting cam (main gear) 32 having an end face cam 32*a*, and a coil spring 39. The main gear 32 and coil spring 39 are employed commonly to a lower knife holder adjusting means 30 described later.

The thread-sliding piece holder 51 is a holding frame which is provided as a body separate from the lower knife holder 20 in order to support the thread-sliding piece 40 and the swinging piece 50. The thread-sliding piece holder 51 is formed in a nearly U-shape, and arranged aside the sewing machine frame 104 (see FIGS. 2 and 3).

Through-holes 51*c*, 51*c* penetrating through side surfaces of the thread-sliding piece holder 51 along the X-axis direction are formed. The thread-sliding piece holder 51 is attached to the sewing machine frame 104 by penetration of the adjusting shaft 34 through the through-holes 51*c*, 51*c*.

Further, as seen from FIG. 2, the thread-sliding piece holder 51 is formed to have a wider width than the sewing machine frame 104 in the X-axis direction in a zone to be attached to the sewing machine frame 104. The thread-sliding piece holder 51 is engaged and supported by the adjusting shaft 34 so that it is slidable along the X-axis direction.

The pin member 53 is inserted into a receiving hole 51*b* formed in the thread-sliding piece holder 51 in a state where it also inserts through both elongate hole 40*d* of the thread-sliding piece 40 and though-hole 50*c* of the swinging piece 50, and secured by a screw 53*a*. Thus, the swinging piece 50 is made swingable around the pin member 53 on the upper surface of the thread-sliding piece holder 51. Through this swinging, the position of the tip of the thread-sliding piece 40 is adjusted in the lateral direction.

The thread-sliding piece finely adjusting lever 61 includes a shaft member and a lever. The lever is formed at one end of the shaft member and serves as a manipulating segment. The other end of the shaft member is pivotally inserted through a through-hole 67 formed along the X-axis direction at a lower part of the holder body 21.

The thread-sliding piece eccentric cam 62 is provided pivotally around the shaft member of the thread-sliding piece finely adjusting lever 61. One end of the link member 63 is slidably coupled with the peripheral surface of the pivotal area.

One end of the link member 63 coupled with the thread-sliding piece adjusting eccentric cam 62 is formed in a U-shape and engaged with the eccentric cam portion of the thread-sliding piece adjusting eccentric cam 62, thereby yo move the link member 63 nearly along the Y-axis direction by the rotational movement of the eccentric cam 62. The link member 63 is attached movably along the Y-axis direction to the side of the thread-sliding piece holder 51 through a elongate hole formed at a middle area thereof. At the other end of the link member 63, a elongate hole 63*a* elongate in the Y-axis direction and a concave portion 63*b* located above the elongate hole 63*a* are formed. A thread-sliding piece swinging groove cam 64 is coupled to both the elongate hole 63*a* and the concave portion 63*b* (see FIGS. 2 and 4).

The thread-sliding piece swinging groove cam 64 is a groove cam having an axis along the X-axis direction, and provided pivotally around the X-axis direction by a through-hole formed on the side of the thread-sliding piece holder 51 and the elongate hole 63*a* formed at the other end of the link member 63. Further, the thread-sliding piece swinging groove cam 64 has a projection formed at its end which is engaged with the concave portion 63*b* of the link member 63. Thus, when the thread-sliding piece swinging groove cam 64 receives the swinging operation of the link member 63 along the Y-axis direction, it can obtain axially rotational movement. Namely, the thread-sliding piece swinging groove cam 64 receives the rotational movement of the thread-sliding piece adjusting eccentric cam 62 through the link member 63.

Further, the thread-sliding piece swinging groove cam 64 has a spiral cam groove formed on the peripheral surface, with which an engagement projection 50*b* formed on the lower surface of the swinging piece 50 is engaged.

In this way, when the thread-sliding piece swinging groove cam 64 is axially pivotally moved, the swinging piece 50 and the thread-sliding piece 40 can be swung laterally via the engagement projection 50*b* engaged in the cam groove on the peripheral surface of the thread-sliding piece swinging groove cam 64.

Specifically, by manipulating the thread-sliding piece finely adjusting lever 61, the thread-sliding piece 40 is laterally swung by means of the thread-sliding piece adjusting eccentric cam 62, link member 63, groove cam formed on the peripheral surface of the thread-sliding piece swinging groove cam 64 and the engagement projection 50*b* engaged in the groove cam so that the lateral position of the tip 40*a* of the thread-sliding piece 40 can be finely adjusted.

Namely, the thread-sliding piece adjusting means 60 has a function of adjusting the lateral position of the tip 40*a* of the thread-sliding piece 40 on the thread-sliding piece holder 51. Thus, the thread-sliding piece 40 is adapted so that the lateral position of the tip 40*a* thereof can be adjusted independently of the lateral position of the lower knife 12.

[Lower Knife Holder Adjusting Means]

Next, the lower knife holder adjusting means 30 will be explained.

The lower knife holder adjusting means 30 in the embodiment is designed to be able to simultaneously move the holder body 21 of the lower knife holder 20 supporting the lower knife 12 and the swinging piece 50 supporting the thread-sliding piece 40 within a partial range in the vicinity of the sewing machine frame 104 on the movable range along the X-axis direction (direction orthogonal to the cloth feeding direction) of the holder body 21 and the swinging piece 50.

More specifically, the lower knife holder adjusting means 30 includes a sleeve 35 through which the adjusting shaft 34 is penetrated, the main gear 32 which is firmly supported in the vicinity of the other end of the adjusting shaft 34 and employed commonly with the thread-sliding piece adjusting means 60, the end face cam 32*a* formed integrally to the main gear 32, the follower gear 33 to which the supporting shaft 22 of the lower knife holder 20 is inserted and also screw-engaged with the main gear 32, the end face cam 33*a* formed integrally to the follower gear 33, and a receiving screw 36 attached in the vicinity of the tip of the supporting shaft 22 and serving as a follower to the end face cam 33*a*.

At one end of the adjusting shaft 34, the adjusting knob 31 is attached. The other end thereof, in the state where it is inserted into the sleeve 35 which is driven in and secured to the sewing machine frame 104, is inserted through the passing-through hole 25 formed in the holder body 21 and the two through-holes formed in the thread-sliding piece holder 51. In addition, the other end of the adjusting shaft 34 is inserted through the lower knife adjusting stand 200 screw-fixed to the sewing machine frame 104 and pivotally supported by the lower knife adjusting stand 200.

In the vicinity of the other end of the adjusting shaft 34 and between the thread-sliding piece holder 51 and the lower knife adjusting stand 200, the main gear 32 is firmly installed. The end face (left end face in FIG. 3) of the main gear 32 is in contact with the lower knife adjusting stand 200. Thus, the adjusting shaft 34 is positioned due to its movement being limited in the X-axis direction by the main gear 32 firmly attached to the adjusting shaft 34 and the E-ring 37 installed oppositely to the main gear 32 with respect to the lower knife adjusting stand 200.

Further, the adjusting shaft 34 has a slot 34*a* for inserting a pin 38 formed in the vicinity of the other end thereof. The main gear 32 has a passing-through hole through which the adjusting shaft 34 is inserted and a engaging groove in which-both ends of the pin 38 are engaged, which are formed in the central area of the main gear 32. Thus, with the pin 38 being installed, when the adjusting shaft 34 is inserted through the main gear 32, the pin 38 serves as a key. So the adjusting shaft 34 and the main gear 32 can be rotated integrally.

Between the sleeve 35 and the thread-sliding piece holder 51, the coil spring 39 and washer are provided. In this state, the coil spring 39 pushes the thread-sliding piece holder 51 so that the thread-sliding piece holder 51 is depressed toward the main gear 32.

In the embodiment, the main gear 32 is equipped with the end face cam 32*a* at the one end thereof, i.e. end face facing the sewing machine frame 104.

The end face cam 32*a* is made rotatable with the main gear 32. According to the rotating degree of the main gear 32 when the adjusting knob 31 is manipulated, the moving amount of the end face 32 is increased or decreased in the direction along the rotating shaft, i.e. X-axis direction.

The end face cam 32*a*, when it is rotated by the rotating operation of the adjusting knob 31, moves a contact pin 51*a* in contact with the cam face of the end face cam 32*a* in the lateral direction (X-axis direction). Namely, the end face cam 32*a* serves to move the thread-sliding piece holder 51 in the X-axis direction through the contact pin 51*a*. Thus, with the rotation of the end face cam 32*a*, the thread-sliding piece 40 supported on the thread-sliding piece holder 51 is moved along the X-axis direction.

Figure 5:
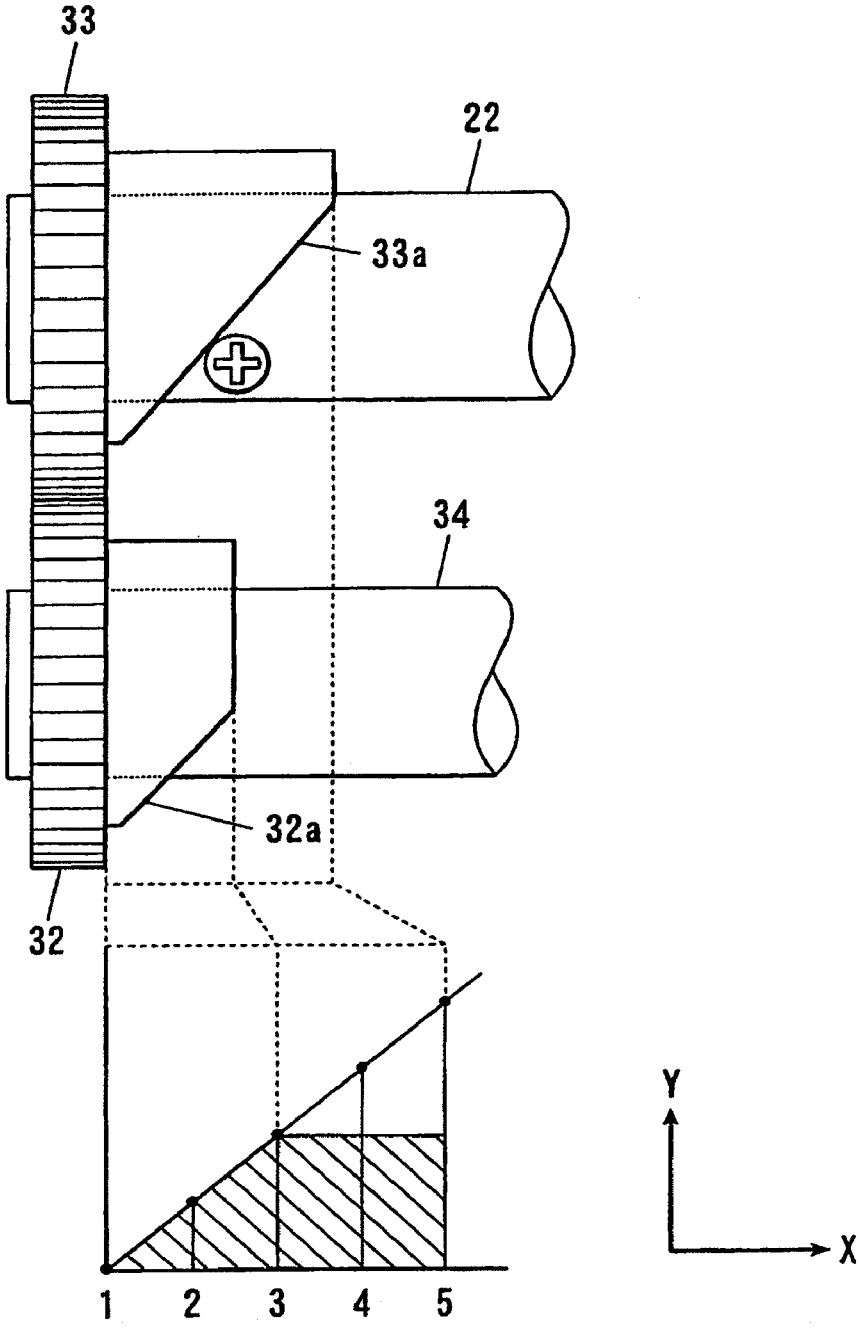
FIG. 5 is a schematic view for explaining moving amounts of end face cams 32*a*, 33*a* in the embodiment.
Figure 6:
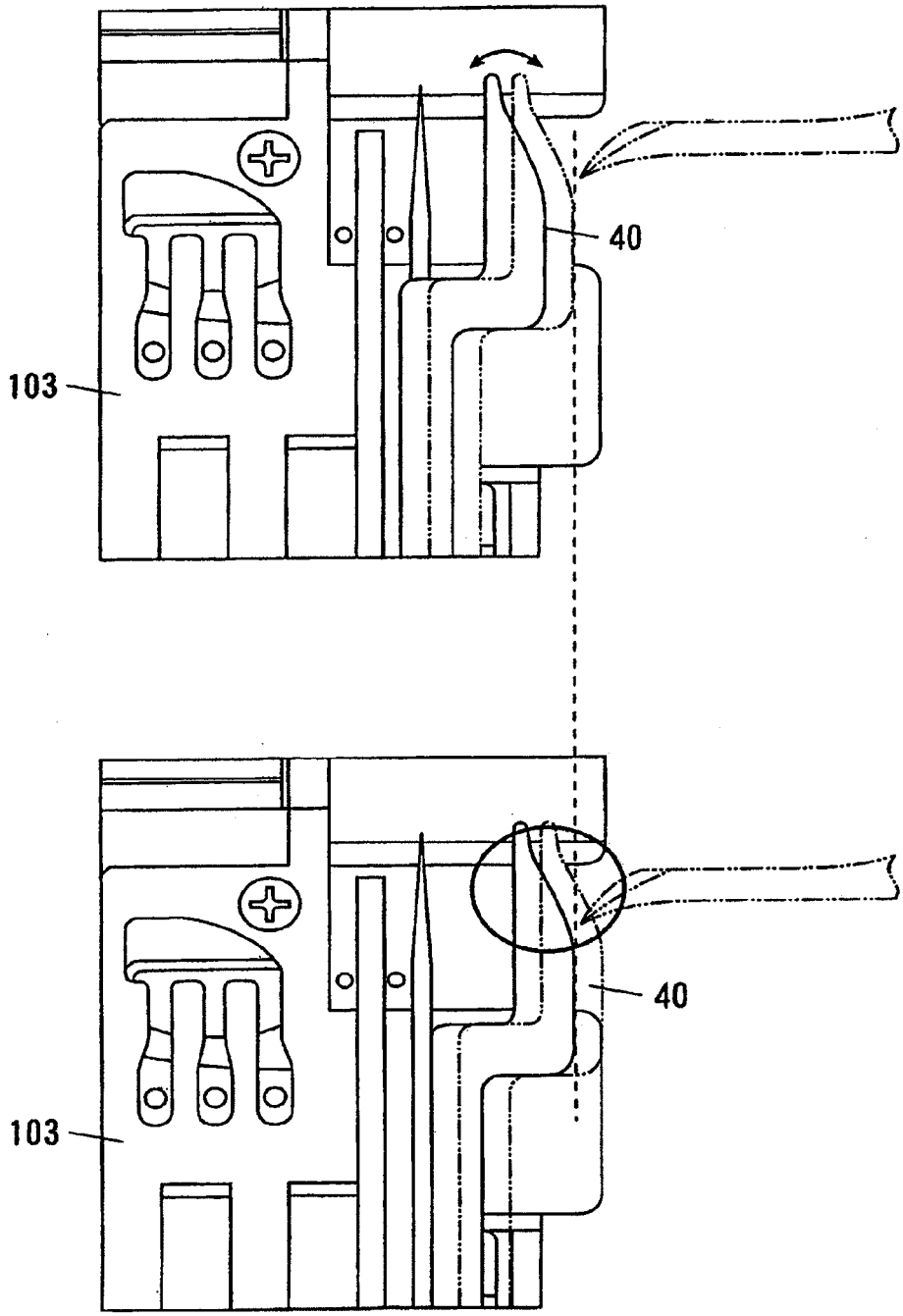
FIG. 6 is a plan view schematically showing a positional relationship between a thread-sliding piece and an upper looper in the related art.

The end face cam 32*a* in the embodiment, as schematically shown in FIG. 5, can be adjusted within a range of moving amount of the thread-sliding piece 40 of 1 to 3 (lifting amount) in the lateral direction, i.e. X-axis direction.

Now, in FIG. 5, the status of the moving amount of 1 refers to the status where thread-sliding piece 40 has approached the sewing machine frame 104 to the utmost, i.e. position assuring the narrowest darning width (first position) in the working range of the thread-sliding piece holder 51 in the X-axis direction. The status of the moving amount of 3 refers to the position of assuring the widest darning width and the farthest position (outside marginal position) where the right edge of the thread-sliding piece 40 does not interfere with the locus of the upper looper directed to the sewing needle 102 when the thread-sliding piece 40 is gradually moved away from the stitch point in the X-axis direction.

Further, the end face cam 32*a* is adapted to proportionally increase or decrease the moving amount within the range of 1 to 3 in the X-axis direction owing to the end face cam 32*a* formed integrally to the main gear 32 within a predetermined range of the rotating angle of the main gear 32, and does not increase the moving amount in a further rotating angle range. Namely, the end face cam 32*a* can be adjusted within the range of moving amount of 1 to 3 due to the end face cam 32*a*, and the position in the X-axis direction is fixed in the range exceeding the moving amount of 3.

The follower gear 33 is supported with the supporting shaft 22 of the lower knife holder 20 inserted through the central hole thereof. The follower gear 33 is rotatably mounted on the supporting shaft 22. The follower gear 33 is limited in its movement by the lower knife adjusting stand 200 so that it does not move leftward from the left side in FIG. 3.

The end face on the sewing machine frame side of the follower gear 33 is the end face cam 33*a* whose moving amount increases or decreases according the degree of rotation. Namely, since the end face cam 33*a* is formed integrally to the follower gear 33, the end face cam 33*a* is also rotated with the rotation of the follower gear 33.

It should be noted that the head of a screw screwed into the supporting shaft 22 is slidably attached to the end face cam 33*a*.

As described above, since the supporting shaft 22 is pushed toward the thread-sliding piece holder 51 by the coil spring 27, the receiving screw 36 serving as the follower fixedly attached to the supporting 22 is brought into pressure-contact with the end face cam 33*a*.

The follower gear 33 is arranged in mesh with the main gear 32.

When the follower gear 33 is rotated, according to the rotating amount, the receiving screw 36 in contact with the cam face of the end face cam 33*a* formed integrally to the follower gear 33 is moved in the X-axis direction. Correspondingly, the lateral position of the lower knife holder 20 as well as the supporting shaft 22 with the receiving screw 36 attached thereon is moved and adjusted. The end face cam 33*a* has a shape permitting the continuous and proportional increase or decrease within the range of moving amount of 1 to 5 in the range of moving amount schematically shown in FIG. 5. The position of the lower knife holder 20 (i.e. lower knife 12) at the moving amount of 1 corresponds to the position of the thread-sliding piece 40 providing the narrowest darning width. The position of the lower knife holder 20 (i.e. lower knife 12) at the moving amount of 3 corresponds to the outside marginal position of the thread-sliding piece 40. The position of the lower knife holder 20 at the moving amounts of 4 and 5 corresponds to the positions further outwardly exceeding the above outside marginal position.

Thus, the follower gear 33 with the end face cam 33*a* is rotated integrally with the rotation of the main gear 32 by the rotating operation of the adjusting knob 31. As a result, as seen from FIG. 5, the moving amount (lifting amount) in the X-axis direction by the end face cam 33*a* is continuously and proportionally increased or decreased within a range of 1 to 5.

Namely, between the moving amounts of 1 and 3, the lower knife holder 20 is moved with the thread-sliding piece holder 51 and swinging piece 50 moved by the end face cam 32*a* according to displacement of the end face cam 33*a*. With the rotation of the follower gear 33 by the rotating operation of the adjusting knob 31, the lower knife holder 20 is solely moved to exceed the moving amount of 3 to reach the moving amount of 5 according to the displacement of the end face cam 33*a*.

As described above, by the rotating operation of the adjusting knob 31, within the range of moving amount of 1 to 3, the lower knife holder adjusting means 30 serves to simultaneously move the lower knife holder 20 holding the lower knife 12 and the swinging piece 50 holding the thread-sliding piece 40; and within the range of moving amount of 3 to 5, the lower knife holder adjusting means 30 serves to laterally adjust only the position of the lower knife holder 20, with the thread-sliding piece 40 and the swinging piece 50 being located at the outside marginal position corresponding to the moving amount of 3.

It should be noted that the thread-sliding piece 40 is moved within the range of moving amount of 1 to 3 by the lower knife holder adjusting means 30, and independently of this, the lateral position of the tip 40*a* thereof can be solely finely adjusted by the thread-sliding piece adjusting means 60.

[Explanation of the Operation]

Referring to the drawings, a detailed explanation will be given of the operation of the darning width adjusting device 10 according to the embodiment.

First, upon over-edge sewing by the sewing machine 100, the darning width adjusting device 10 is set to position the tip 40*a* at the using position by previously manipulating the switching knob 40*b* of the thread-sliding piece 40. In this state, the workpiece cloth fed according to the sewing operation is cut at an upstream side of the sewing needle 102 in the Y-axis direction by the upper knife 11 driven vertically and the lower knife holder 12 supported by the lower knife holder 20. On the other hand, the sewing machine 100 executes the darning along the end of the workpiece cloth in the Y-axis direction formed by this cutting.

More specifically, a looper thread not shown is inserted through a loop of the sewing thread formed by the vertical movement of the sewing needle 102 and picked up on the tip 40*a* of the thread-sliding piece 40 positioned in the vicinity of the cut end of the workpiece cloth by the looper not shown. Further, the sewing thread is inserted through a loop of the looper thread at the stitch point on the upper surface of the workpiece cloth by the sewing needle 102. Further, the looper thread picked by the tip 40*a* of the thread-sliding piece 40 comes off the tip so that it is released. By repeating the above operation, the darning is executed.

Now, in adjusting the darning width or the position in the X-axis direction of the lower knife 12, the adjusting knob 31 is rotated to rotate the adjusting shaft 34.

Thus, the thread-sliding piece holder 51 and lower knife holder 20, as described above, are moved in the X-axis direction with the range of moving amount of 1 to 3 so that they are positioned at predetermined positions.

Namely, they are positioned at desired positions within the range of moving amount of 1 to 5 as illustrated in FIG. 5.

Concretely, in the lower knife holder adjusting means 30, when the adjusting shaft 34 is given the rotating force by the adjusting knob 31, the main gear 32 is rotated. Correspondingly, the follower gear 33 is rotated and so the end face cam 33*a* is also rotated. The follower gear 33 is limited in its movement in the X-axis direction (leftward in FIG. 3) by the lower knife adjusting stand 200. Therefore, with the rotation of this follower gear 33, according to the height in the central axis direction of the end face cam 33*a*, the lower knife holder 20 is moved along the X-axis direction through the receiving screw 36 and supporting shaft 22. Thus, by rotating the adjusting knob 31 by a necessary degree, the lower knife holder 20 and the lower knife 12 are positioned in the X-axis direction.

In changing the darning width, the adjusting knob 31 is rotated to position the thread-sliding piece holder 51 supporting the thread-sliding piece 40 and swinging piece 50 at the predetermined position in the lateral direction. Namely, for example, by the rotating the adjusting knob 31, the thread-sliding piece 40 is positioned at a desired position within the range of moving amount of 1 to 3 as illustrated in FIG. 5.

Figure 4:
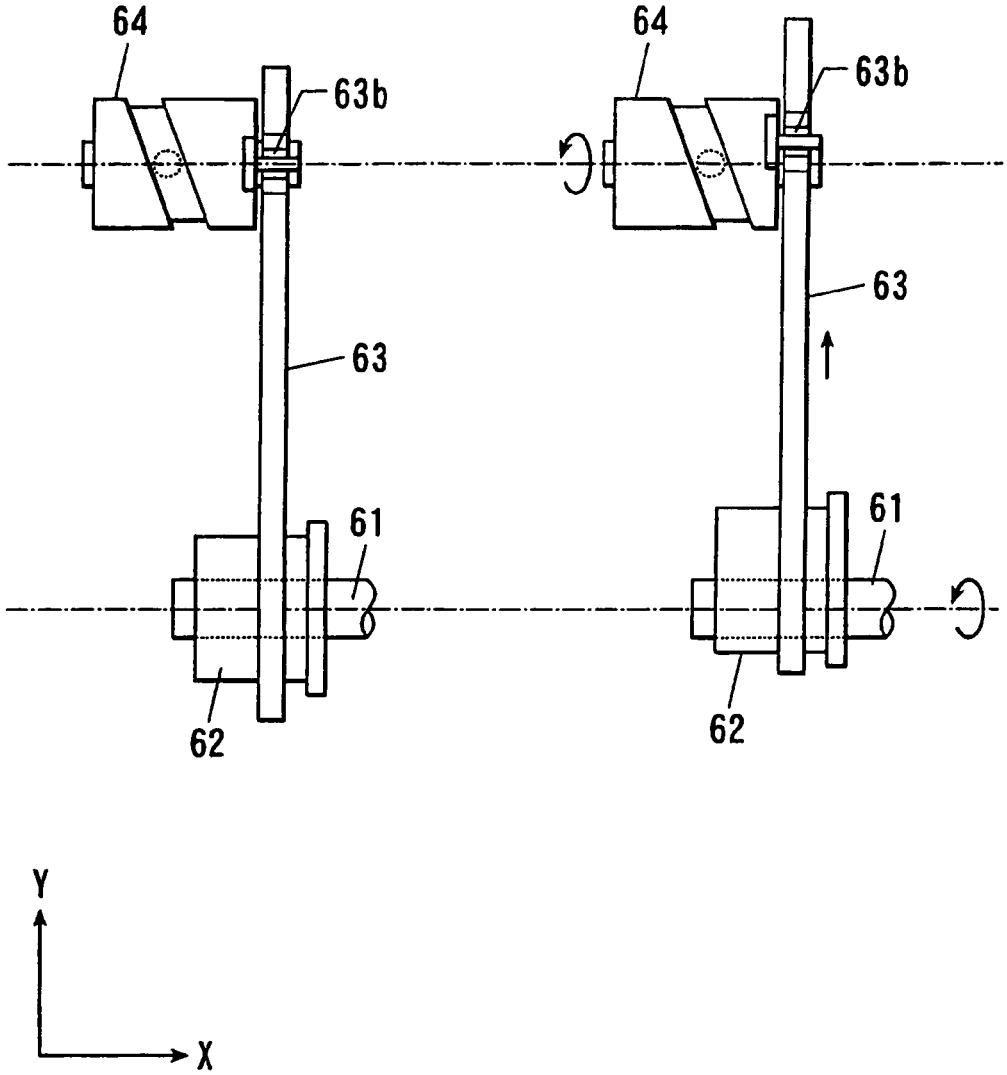
FIG. 4 is a schematic view for explaining an operation of a thread-sliding piece adjusting means in the embodiment.

In adjusting the darning width, in addition to the manipulation of the adjusting knob 31, it is solely finely adjusted by manipulating the thread-sliding piece finely adjusting lever 61 to swing the tip 40*a* of the thread-sliding piece 40 (see FIG. 4).

Specifically, when the thread-sliding piece finely adjusting lever 61 is rotated, the thread-sliding piece adjusting eccentric cam 62 secured thereto is rotationally moved. With the rotational movement of the thread-sliding piece adjusting eccentric cam 62, the link member 63 with the one end coupled with the peripheral surface of the eccentric area of the eccentric cam 62 is moved almost along the Y-axis direction. Correspondingly, at the other end of the link member 63, the thread-sliding piece swinging groove cam 64 is pivoted on an elongate hole 63*a* and given the rotational movement by the pin engaged with the concave portion 63*b* thereabove so that it is pivotally around the axis in parallel to the X-axis.

With the rotational movement of the thread-sliding piece swinging groove cam 64, the engagement projection 50*b* engaged in the groove cam formed on the peripheral surface of the thread-sliding piece swinging groove cam 64 is moved laterally, i.e. in the X-axis direction. Thus, around the one end of the swinging piece 50 fixed swingably by the pin member 53, the other end thereof is swung almost along the X-axis direction. Correspondingly, the thread-sliding piece 40 supported on the swinging piece 50 (particularly, its tip 40*a*) is swung along the X-axis direction (see FIG. 4).

Further, the thread-sliding piece 40 has a function of assuring the predetermined darning width when the sewing thread is tightened by tension applied by hanging of the looper thread on the tip 40*a*. Thus, by the arrangement of the thread-sliding piece 40, the darning width can be determined. An explanation will be given below of the operation of positioning the tip 40*a* of the thread-sliding piece 40 in the direction orthogonal to the cloth feeding direction.

First, in order to determine the cutting position in the direction (lateral direction) orthogonal to the feeding direction of the workpiece cloth, the lower knife 12 is positioned in the lateral direction. The lower knife is positioned by the lower knife adjusting means capable of adjusting the moving position of the lower knife holder 20 in the lateral direction.

By swinging the thread-sliding piece holder 51 using the adjusting knob 31 in the lower knife holder adjusting means 30, the tip 40*a* of the thread-sliding piece 40 is moved in the lateral direction so as to be positioned at the predetermined position.

Further, the thread-sliding piece 40 is supported movably in the cloth feeding direction by the thread-sliding piece holder 51. Thus, the darning is made possible with the tip 40*a* of the thread-sliding piece 40 being moved to the vicinity of the stitch point in the cloth feeding direction. With the tip 40*a* moved in the opposite direction, stitching not using the thread-sliding piece (e.g. winding-stitch) is made possible. In this way, the thread-sliding piece is switched between the using state and non-using state.

[Effects of the Embodiment]

As understood from the description hitherto made, in accordance with the darning width adjusting device 10 according to the embodiment, since the lower knife 12 is supported by the lower knife holder 20 and the thread-sliding piece 40 is the thread-sliding piece holder 51, he lower knife holder 20 and the thread-sliding piece holder 51 different bodies, the thread-sliding piece 40 and the lower knife 12 can be independently moved. In addition, the lower knife 12 can be moved more outwards than the outside marginal position to which the thread-sliding piece holder 51 is moved in the lateral direction. Thus, the cutting width relative to the darning width, i.e. the width from the stitch point to the cutting position by the upper knife 11 and the lower knife 12 can be assured widely without being limited by the moving amount of the thread-sliding piece 40 which may interfere with the upper looper. Accordingly, even when darning is made on the elastic cloth, the darning can be suitably aligned to the cloth end after cutting. As a result, darning can be suitably made on various cloths.

Further, in the lateral direction, the moving amount of the lower knife holder 20 and the moving amount of the thread-sliding piece holder 51 can be independently adjusted. Therefore, both distances-of the thread-sliding piece 40 and the lower knife 12 from the stitch point can be set freely. Thus, even when darning is sewn on the elastic cloth, it can be suitably made according to material changes with no thread redundancy or thread shortage due to the thickness or contractive property of the elastic cloth.

Further, since the thread-sliding piece 40 is involved with the thread-sliding piece adjusting means 60 capable of solely adjusting the lateral position of the tip 40*a* thereof, fine adjustment of the-darning width can be easily made with no movement of the thread-sliding piece holder 51 and lower knife holder 20 in the lateral direction. By combining the adjusting means for the thread-sliding piece holder 51 and the lower knife holder 20 to move in the lateral direction, the adjustable range of the darning width can be further extended, and the operation of adjusting the darning width can be simplified, thereby improving the working efficiency.

It should be noted that the thread-sliding piece holder 51 supporting the thread-sliding piece 40 should not be limited to the embodiment, but can be adopted as long as the moving position of the thread-sliding piece holder 51 can be adjusted independently from the lower knife holder 20.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A darning width adjusting device for a sewing machine, wherein the sewing machine cuts an edge of a workpiece fed to a stitch point by an upper knife and an lower knife arranged at an upstream side of the stitch point in a cloth feeding direction, the darning width adjusting device for a sewing machine comprising:

a lower knife holder which holds the lower knife and supported by a sewing machine frame such that a moving position of the lower knife holder is adjustable in a direction orthogonal to the cloth feeding direction;

a thread-sliding piece which sets a darning width by picking up a thread on a tip of the thread-sliding piece in a vicinity of the stitch point;

a thread-sliding piece holder which holds the thread-sliding piece and supported by the sewing machine frame such that a moving position of the thread-sliding piece is adjustable in the orthogonal direction to the cloth feeding direction from a first position providing the narrowest darning width to an outside marginal position providing the widest darning width;

a thread-sliding piece adjusting means for moving the thread-sliding piece holder such that the moving position of the thread-sliding piece is adjusted from the first position to the outside marginal position; and a lower knife holder adjusting means for adjusting the moving position of the lower knife holder from a position corresponding to the first position of the thread-sliding piece to another position exceeding a position corresponding to the outside marginal position of the thread-sliding piece.

2. The darning width adjusting device for a sewing machine according to claim 1, further comprising thread-sliding finely adjusting means for adjusting a moving position of the tip of the thread-sliding piece with respect to the thread sliding piece holder in the orthogonal direction to the cloth feeding direction.

3. The darning width adjusting device for a sewing machine according to claim 1, further comprising:

an adjusting shaft provided parallel to the orthogonal direction to the cloth feeding direction and slidably supported by the sewing machine frame, the adjusting shaft penetrating through the lower knife holder, wherein the lower knife holder has a supporting shaft extending parallel to the adjusting shaft and slidably supported by the sewing machine frame, the thread-sliding piece holder is slidably supported by the adjusting shaft, the supporting shaft is coupled with the lower knife holder adjusting means, and the adjusting shaft is coupled with the thread-sliding piece adjusting means.

4. The darning width adjusting device for a sewing machine according to claim 2, further comprising:

an adjusting shaft provided parallel to the orthogonal direction to the cloth feeding direction and slidably supported by the sewing machine frame, the adjusting shaft penetrating through the lower knife holder, wherein the lower knife holder has a supporting shaft extending parallel to the adjusting shaft and slidably supported by the sewing machine frame, the thread-sliding piece holder is slidably supported by the adjusting shaft, the supporting shaft is coupled with the lower knife holder adjusting means, and the adjusting shaft is coupled with the thread-sliding piece adjusting means.

5. The darning width adjusting device for a sewing machine according to claim 1, wherein the moving position of the thread-sliding piece holder is not adjusted while the moving position of the lower knife holder is adjusted between the position corresponding to the outside marginal position of the thread-sliding piece and the position exceeding therefrom.

6. The darning width adjusting device for a sewing machine according to claim 1, wherein:

the thread-sliding piece adjusting means comprises a first gear and a first cam which rotates together with the first gear;

the lower knife holder adjusting means comprises a second gear and a second cam which rotates together with the second gear; and the first gear and the second gear are engaged with each other.

* * * * *